United States Patent [19]

Capasso

[11] 4,413,626

[45] Nov. 8, 1983

[54] FOUNDATION GARMENT

[75] Inventor: Ursula Capasso, Hollis, N.Y.

[73] Assignee: Exquisite Form Industries, Inc., Pelham Manor, N.Y.

[21] Appl. No.: 266,168

[22] Filed: May 22, 1981

[51] Int. Cl.[3] ..... A41C 3/00

[52] U.S. Cl. ..... 128/498; 128/510

[58] Field of Search ..... 128/498, 493, 445, 502, 128/512, 491, 443, 487, 479, 534, 483, 510, 477

[56] References Cited

U.S. PATENT DOCUMENTS

| | | | |
|---|---|---|---|
| Re. 24,640 | 4/1959 | Hunau | 128/493 |
| 3,075,530 | 1/1963 | Smith | 128/477 |
| 3,430,632 | 3/1969 | James et al. | 128/510 |

*Primary Examiner*—Doris L. Troutman

*Attorney, Agent, or Firm*—Lackenbach, Siegel, Marzullo, Presta & Arnson

[57] ABSTRACT

An improved brassiere construction featuring breast engaging cup portions which are adjustable in size and shape and which are each comprised of an upper and lower panel that are in engagement with one another along an arcuate line, and form the major portion of the semi-spherical cup portion. The material forming the cup panels is substantially distensible in one direction only. The construction also includes body encircling portions which are distensible in the direction encircling the wearer and there is provided a buckle and strap means for gathering and urging downwardly the innermost portion of the upper panel comprising the cup portion. The direction of maximum distensibility of the material in the upper and lower panels forming each breast cup portion changes in alignment with respect to each other along an arcuate line of engagement therebetween. The interplay of the different directions of maximum distensibility of the fabrics forming the brassiere allows for a wide range of size and shape adjustment of the cup portions with a minimum of bagging and a maximum of shaping and support.

7 Claims, 9 Drawing Figures

FIG. 1
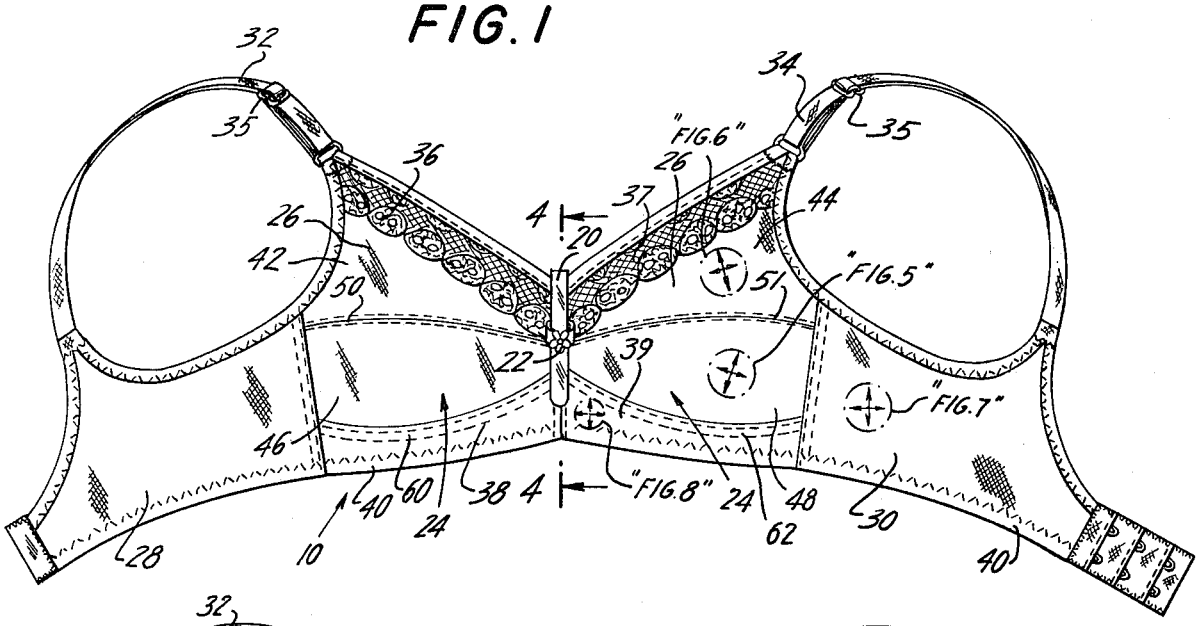
FIG. 2
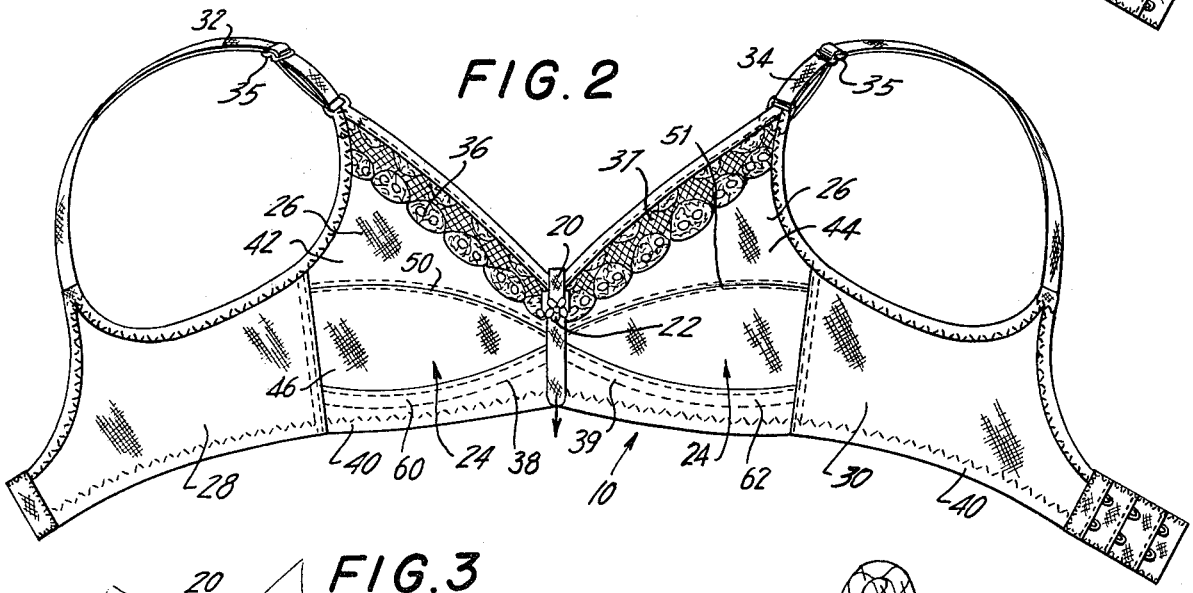
FIG. 3
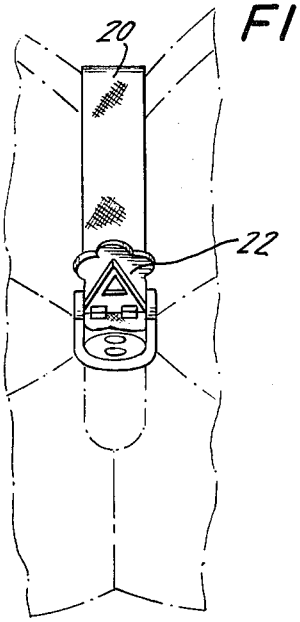
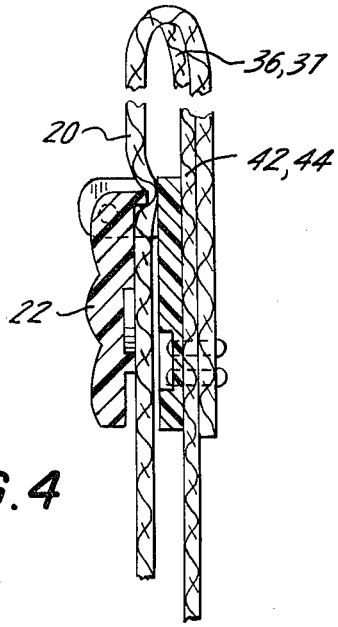
FIG. 4

FIG. 6
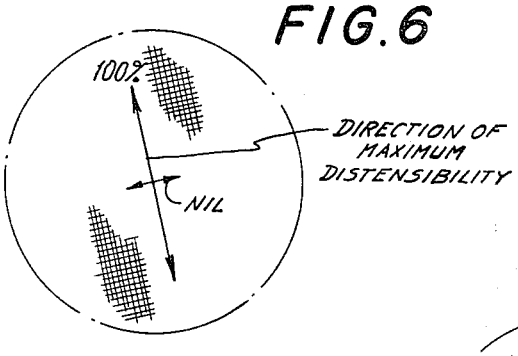
FIG. 5
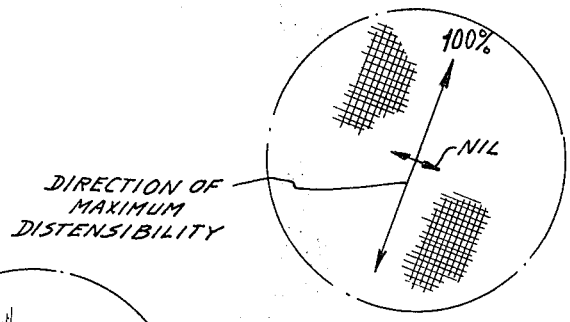
FIG. 7
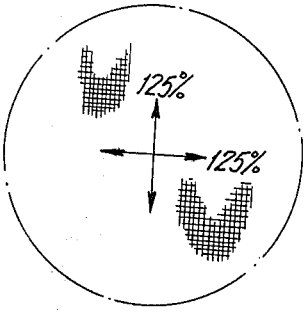
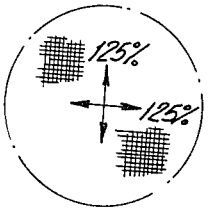
FIG. 8
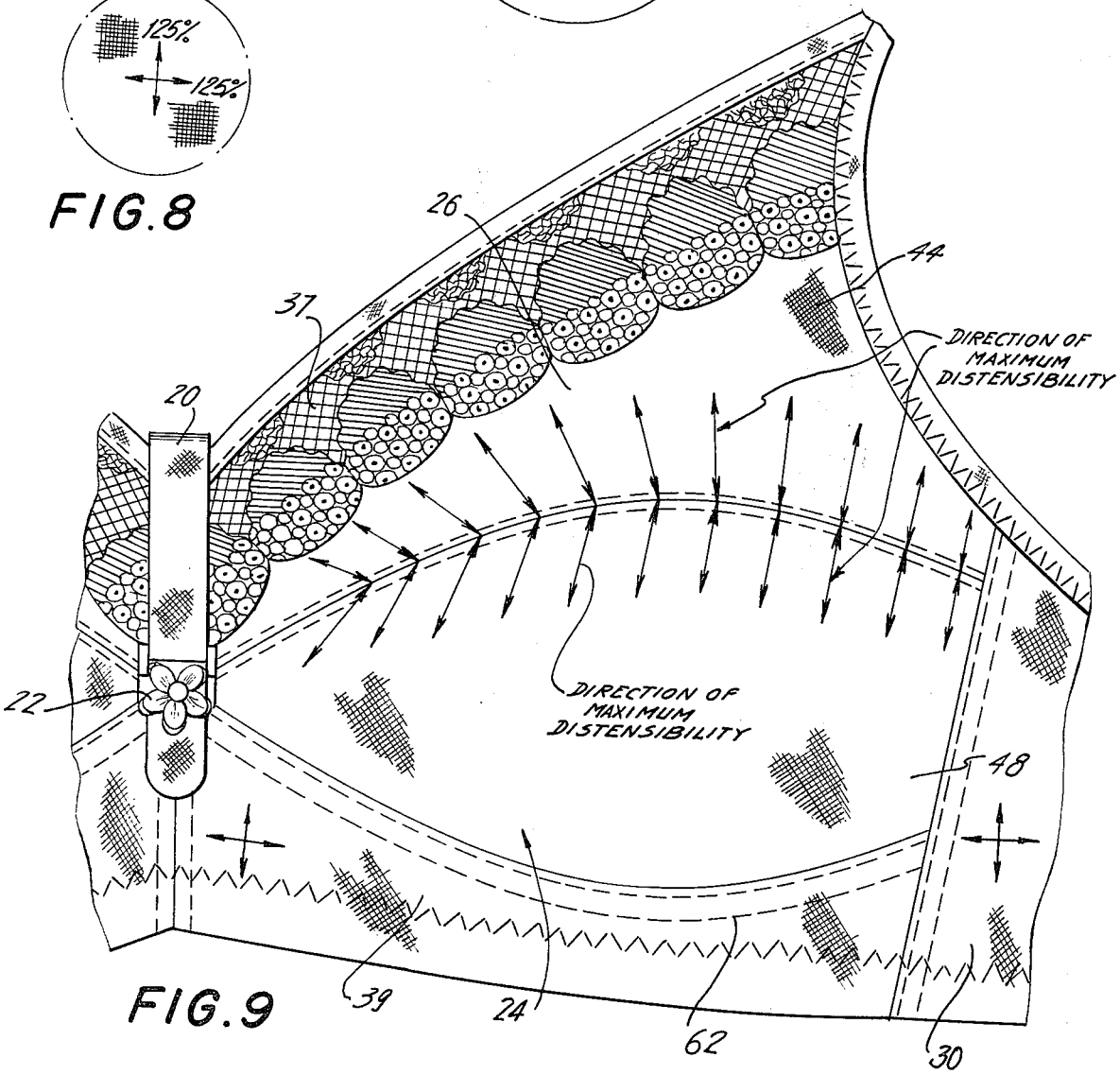
FIG. 9

FOUNDATION GARMENT

BACKGROUND OF THE INVENTION

1. Field of the Invention

The present invention relates to an improved brassiere having adjustable breast covering or cup portions, and more particularly to a brassiere having cup portions formed of at least two panels of material which are distensible substantially in one direction only, and which direction of distensibility changes or varies with respect to each other along an arcuate line of engagement.

2. Description of the Prior Art

The prior art is replete with improvements in brassiere or bra constructions, and heretofore various means of adjusting the cup size portions of brassieres were known. Those skilled in the art will appreciate that having means located between the two cup portions which gather and urge downwardly the material therebetween to change the shape and size of the cup portions is conventional, but have distinct disadvantages such as loss of shaping and support, and extensive bagging of material, at various degrees of adjustment. In prior art adjustable cup size brassieres, the breast engaging pockets are made of materials which are not substantially stretchable, expandable, or distensible and therefore cause extensive changes in the degree of support and smoothness of the cup portions as such materials are gathered during cup size adjustment.

Various constructions for adjusting the cup size and shape of a brassiere have heretofore been tried with a central adjusting means. In non-adjustable cup size brassieres a stretchable or expandable fabric has been used as a cup-forming fabric. Such prior art brassieres may be exemplified by the following U.S. patents:

GUIDONI—U.S. Pat. No. 4,031,900
GUBERMAN, et al—U.S. Pat. No. 3,525,341
COUSINS—U.S. Pat. No. 3,338,241
SLOATE—U.S. Pat. No. 3,247,853
DUGAN—U.S. Pat. No. 3,093,137
SCHACHT—U.S. Pat. No. 2,484,467
GLASSER—U.S. Pat. No. 2,296,343
CUNNINGHAM—U.S. Pat. No. 1,718,033
HUNAU—U.S. Pat. No. Re. 24,640 and the following French patent:

LAPCHIN—French Pat. No. 46,978.

The above-listed patents show a variety of ways in which breast cups, and the like, may be adjustable, or show the use, in some instances, of stretchable material that is distensible in all directions. However, none of the prior art patents, taken singly or in combination, show the use of a breast cup having at least two panels in engagement with one another along a substantial portion of each, and which panels are made of a material substantially distensible in one direction only. The patent issued to GUIDONI shows the use of a central means for gathering fabric, thereby changing the overall size of the cup portions, but shows only a single piece of fabric which is stretchable in all directions, and, therefore, does not offer structural support and shaping aspects during adjustment.

The patents issued to COUSINS, DUGAN and SLOATE all show brassieres of non-distensible or non-stretchable fabric comprising the cup portions, and the other prior art patents do not show a combination of distensible fabric in connection with breast cup size and/or shape adjustment.

As those skilled in the art will appreciate, and, as will be explained below in greater detail, the prior art does not include an adjustable cup brassiere utilizing at least two panels of material distensible substantially in one direction only.

SUMMARY OF THE INVENTION

The improved brassiere of the present invention has bust covering and supporting sections or cup portions, and a body encircling portion extending from either side thereof. The brassiere also includes a buckle and strap means for adjusting the size and shape of the bust cup portions. Each cup portion is comprised of an upper and lower panel of material distensible substantially in one direction only. Each such upper and lower panel is cut and shaped such that the direction of maximum distensibility of the material is in alignment with respect to each other at one end of the arcuate line of engagement of such panels, and changes to an acute angle at the other end thereof. There is provided a body encircling portion of material that is distensible at least horizontally, around the body. The cup size adjustment means includes a buckle and strap for gathering and urging together the material of the upper panels of the cup portions.

It is an object of the present invention to provide an improved brassiere construction whereby the cup portions thereof may be adjustable in shape and size, all the while maintaining desired structural support and shaping, and reducing bagging and wrinkling of the material of the cup area.

It is a further object of the present invention to provide a brassiere having cup portions comprised of at least an upper and lower panel, in juxtaposition to each other along an arcuate line of engagement, wherein each panel is comprised of material distensible substantially in one direction only, and wherein said direction of maximum distensibility of each upper and lower panel changes with respect to each other along the line of engagement.

It is still yet a further object of the present invention to provide a brassiere having body encircling panels comprised of a material distensible at least in the direction around the body.

It is a further object of the present invention to provide a brassiere which provides for shape and size adjustment of the cup portions, is made of distensible materials, which offers support advantages over prior art constructions and provides for different molding effects for use with different types of outer garments, for example, dresses with varying depths of neckline.

It is a further object of the present invention to provide a garment with a buckle and strap means for varying the cup size, and cup portions of distensible materials such that variations of the bust size due to minor weight gain and loss and menstruation, and the like, may be accommodated without requiring a different brassiere.

It is yet still a further object of the present invention to provide a brassiere where a simple manual manipulation is all that is necessary to alter the size and shape of the cup portions thereof and obtain a more accentuated contour where such is desired for certain dresses.

The present invention provides advantages over prior art constructions and provides improved support and shaping over varying sizes of the cup portions.

Still further objects and advantages of the present invention reside in an improved brassiere construction which is not unduly expensive to manufacture, simple to utilize and adjust by the wearer, thereby permitting wide use and distribution, and prompting customer usage and acceptance.

These objects, together with the various ancillary objects and features of the present invention, which will become apparent as the following description proceeds, are obtained by the improved brassiere construction, a preferred embodiment of which is shown in the accompanying drawings by way of example only.

DETAILED DESCRIPTION OF THE DRAWINGS

FIG. 1 is a front view of a brassiere employing a construction in accordance with the present invention;

FIG. 2 is a front view similar to that in FIG. 1, showing the brassiere after adjustment for smaller cup portions due to contracting the loop of the strap;

FIG. 3 is a schematic enlarged representation illustrating the interaction between the strap and the buckle;

FIG. 4 is a vertical sectional view taken along the plane of line 4—4 in FIG. 1;

FIG. 5 is an enlarged detail of the material of the lower cup panel taken at location "5" in FIG. 1;

FIG. 6 is an enlarged detail of the material of the upper cup panel taken at location "6" in FIG. 1;

FIG. 7 is an enlarged detail of the material of the body encircling panel taken at location "7" in FIG. 1;

FIG. 8 is an enlarged detail of the material of the lower support panel taken at location "8" in FIG. 1;

FIG. 9 is a schematic enlarged representation of the right cup portion showing the upper and lower panels thereof and illustrating the changing directions of maximum distensibility of the fabrics with respect to each other along the arcuate line of engagement.

DETAILED DESCRIPTION OF THE INVENTION

With reference to the accompanying drawings, wherein similar reference numerals throughout the various views designate similar parts of the present invention, reference numeral 10 is used generally to designate a brassiere constructed in accordance with the concepts of the present invention. Those skilled in the art will appreciate that the brassiere 10 of the present invention is of the type which permits variation of the cup portions thereof for a variety of reasons. The size and shape of the cup portions may be varied to accommodate slight or minor changes in breast size due to small weight gain or loss, as well as during the menstrual cycle, and in order to accommodate different styles of outer garb, for example, dresses with varying depths of neckline.

In the preferred embodiment of the present invention 10, as depicted in the drawings, there is provided an adjusting strap 20 which operates in connection with a buckle 22 allowing for gathering of the material forming the inner portions of the bust covering or cup portions 24 and 26, and move the upper edge of the cup portions downwardly.

The brassiere 10 includes bust covering sections or cup portions 24 and 26, and body encircling panels 28 and 30 extending from the outer sides of cup portions 24 and 26. Shoulder straps 32 and 34 are affixed to the upper edges of the cup portions 24 and 26 as well as to the body encircling panels 28 and 30, and may be adjustable in length by the use of a buckle 35 or related means as is conventional in this art.

There may also be provided along the upper edge or portion of the cup portions 24 and 26 an elongated decorative panel or edging 36 and 37 which is preferably an open mesh or lace which is pleasing and attractive in appearance. Beneath the cup portions 24 and 26 are the base panels 38 and 39 and a lower horizontal elastic tape or rib which runs preferably continuously from one end of the brassiere 10 to the other.

A primary object of the present invention is to provide bust covering portions which may be varied in size and shape, and which will retain proper support and shaping with a minimum of fabric bagging and loss of support throughout the various positions of adjustment. The provision of upper cup panels 42 and 44 and lower cup panels 46 and 48 are particularly important in accomplishing this object. The upper cup panels 42 and 44 and lower cup panels 46 and 48 comprising the three-dimensional semi-spherical cup portions 24 and 26 are contiguous along a major portion of their outer edge defining arcuate lines of engagement 50 and 51. In the preferred embodiment, the panels are joined along the arcuate lines 50 and 51 by being sewn in a conventional manner. Both the upper cup panels 42, 44 and the lower cup panels 46, 48 are somewhat elliptical or "eye" shaped, and are cut and sewn into the brassiere 10 so as to form a smooth, convex pocket or semi-spherical pocket as will be readily understood by those knowledgeable in the brassiere art.

The decorative panels or edge trim 36 and 37 may be any conventional type of decorative lace or open mesh, and the like, and made from any suitable material such as cotton or synthetic cotton blends, for example, which is pleasing to the eye and can withstand the type of washing and cleaning normally associated with an undergarment. The decorative panels 36 and 37 may be affixed to the upper cup panels 42, 44 by conventional means, such as by sewing. The body encircling panels 28 and 30 may be affixed to the bust covering portions by conventional means, such as by sewing, in the same way the straps 32 and 34 are joined to the body encircling panel and bust covering portions, and in the same way the base panels 38 and 39 are joined to the cup portions, and other adjoining panels. In the preferred embodiment, the lower horizontal tape 40 is a continuous piece of elastic material which is sewn onto the body encircling panels 28 and 30, and the base panels 38, 39, and completely surrounds the girth of the wearer when the body encircling panels are joined or hooked together around the back of the wearer as is conventional, by using by hooks and eyes, and the like. Any suitable conventional means for joining the encircling panels 28 and 30 may be utilized in the present invention.

The present invention represents a substantial improvement over prior art adjustable cup brassieres in that the entire cup portions, except for the decorative panels 36 and 37, are comprised of a material or materials which are distensible or stretchable in substantially one direction only. That is, the material used to form the upper and lower cup panels is woven or structured such that in a given predetermined direction, it is distensible from approximately 75 to 150 percent its normal relaxed size, and such distensibility drops to under 10 percent, or nil, as it is sought to be distended in a direction 90 degrees to the direction of maximum distensibility. Such direction of maximum distensibility is depicted in the various figures by way of arrows, and illustrates the direction in which the particular fabric will exhibit stretch.

Distensible or elastic fabrics are known by those in the brassiere art, and may be of a lock stitch or mesh weave, for example, or of any conventional weave or stitch, which allows for stretch in substantially one direction only. Such fabrics may be comprised of fibres including Lycra and Nylon in combination with other conventional fibres and/or threads, and such fabrics are readily available to the undergarment industry. In the preferred embodiment, the fabric comprising the upper and lower cup panels is the same, even though utilizing a fabric having the same degree of distensible specifications is not necessary in forming the upper and lower panels of a given cup portion, and would also be within the scope of the present invention.

In the preferred embodiment maximum distensibility from 95 to 115 percent is most desirable. It must be appreciated that in forming a three-dimensional, smooth, curved pocket, such as the cup portions 24 and 26 which are substantially semi-spherical, the fabric forming the upper and lower panels is cut along curved or arcuate lines. Those skilled in this art appreciate that a piece of flat fabric may be cut and sewn into a brassiere garment by the use of various panels, to produce a substantially smooth three-dimensional convex section.

The direction of maximum distensibility of the fabric used to form the upper and lower panels is uniform and parallel throughout the entire surface area of the fabric, and therefore each separate panel 42, 44, 46 and 48.[1] However, when joining the respective upper and lower panels of each cup portion along the arcuate lines 50, 51, the fabric is cut in a curved fashion which respect to the direction of maximum distensibility, so that along the lines 50 and 51 the alignment of the distensibility of the upper and lower panels changes. With specific reference to FIGS. 1 and 9, wherein the linear direction of maximum distensibility of each fabric panel at various points is depicted by arrows, the orientation or alignment of the direction of maximum distensibility varies. In the preferred embodiment, the fabric comprising the upper and lower bust portions are cut and positioned such that, with reference to FIG. 9, at the right hand side of the cup portion at area A, the lines of maximum distensibility are in alignment, or 180 degrees to each other. As one moves to the left, along the arcuate line of joining 50, the lines of maximum distensibility change or vary at the point of engagement of the respective panels such that at the left or area B such lines are smaller than 90 degrees forming an acute angle. The change in direction of distensibility of the upper and lower panels along their area of engagement in the approximate area at the middle of each cup portion allows the upper cup portions to be changed in shape by the action of strap 20, all the while maintaining proper shaping and support of the bust of the wearer, over the various degrees of adjustment.

[1]Even though it may appear differently from the drawings at first blush, which depict in two dimensions a three dimensional portion of the brassiere.

Prior art adjustable cup brassieres have cup portions made of substantially non-distensible or non-stretchable fabric, and therefore undergo extensive bagging of the fabric in the area of the strap and buckle when the brassiere is in a mode of maximum adjustment as depicted in FIG. 2 herein. Such bagging is undesirable in that it creates creases which show through outer garments, and hinders the ability of the brassiere to properly support and shape.

In the present invention, quite to the contrary, and owing to the disposition and orientation of the stretchable or distensible fabrics which stretch substantially in one direction only, the panels of the cup portions interact so as to maintain support and keep bagging of the material to a minimum. FIGS. 5 through 8 show in enlarged detail general orientation and directional distensibility of the respective fabrics, and the imaginary or descriptive lines depicting the direction of maximum distensibility enable one skilled in the art to appreciate the various and different orientations of such fabric comprising the upper and lower cup panels.

Decorative panels 36 and 37 may be of a material with minor or little distensibility in any direction, as along the very upper portions of the cup panels, a minimum of shaping and support is required. Panels 36, 37 are an area of the bra 10 possibly exposed to view, and the area which undergoes the most gathering by the action of strap 20. Therefore, a thin or light open weave fabric is preferred.

The base panels 38 and 39 are preferably of a material which is distensible in a plurality of directions, and in the preferred embodiment a material which is distensible in all directions approximately 125 percent. The base panels are preferably of the same material as the body encircling panels. In order to enable the brassiere to properly shape and support the lower area of the user's breasts, a non-stretchable tape 60 and 62 is sewn in a smooth curve around the lower portions of each cup portion as shown in the drawings.

The orientation and direction of maximum distensibility of the fabrics used for upper and lower cup portions, with respect to each other and with respect to the brassiere as a whole, in connection with the distensible or stretchable fabrics forming the body encircling panels and base panels, have been designed and oriented in connection with experimentation to provide a brassiere capable of shaping and supporting in the various positions of adjustment. It must be appreciated that the substantially arcuate shape of the joining lines allows the fabric of the upper and lower panels to be cut and joined to form a smooth curved surface. It is along the arcuate lines 50 and 51 that the relative change in direction of maximum distensibility of the respective fabrics may be seen as exemplified by FIG. 9. One skilled in the art can appreciate the forces and lift being applied to the bust of the wearer due to the fabric being distensible in substantially one direction only, and appreciate that as the brassiere 10 is adjusted to a position as depicted in FIG. 2, the fabrics comprising the cup portions maintain the desired shaping and lifting forces on the bust of the wearer. The shape of the non-stretchable portions 60 and 62 help define a desirable shape at the bottom edge of cup portions, and form a portion onto which the base panels 38 and 39 may be sewn.

The strap 20 is preferably secured to the inner surface of the inner edges of the lower bust supporting panels, between the cups, such that the strap 20 is secured by sewing or the like at only one of its ends, along the medial line of the brassiere. The strap 20 extends upwardly over the top of the cup portions, over and above the decorative panels 36 and 37, and extends forwardly and downwardly in front of the brassiere passing through a buckle 22 which is mounted on the exterior surface of the cup portions, at approximately the point where the upper and lower cup portions meet. The location of the buckle may be adjusted upwardly or downwardly so that the amount of the upper cup panels and decorative panels which is encircled by the strap may be changed.

As may be readily seen in FIG. 4, the buckle 22 and strap 20 are firmly secured on either side of the cup portions, and the free end of the strap is disposed through the buckle 22 such that it may be manipulated and pulled downwardly readily by the user. The buckle comprises a frame which is the part of the buckle secured to the brassiere and has pivotally hinged thereto a rotating member which is preferably decorative in form, and includes serrations or lugs extending therefrom so that upon rotation the lugs forceably retain the strap within the buckle in any of a plurality of positions along the length of the strap 20. Such buckles 22 are conventional in the art, and readily available to those in this industry and any other suitable means may be utilized whereby the strap may be locked in several positions along its length as it is drawn through the buckle.

Strap 20 provides a loop, as may be readily seen in FIGS. 3 and 4, between its mounted end and the end which passes through the buckle, and such loop passes around the medial line of the brassiere enclosing the upper panels and decorative panels of the bust covering portions.

FIG. 1 illustrates the condition of the brassiere when the loop provided by the strap is extended to a maximum, so that the upper panels and decorative panels are fully extended and unrestricted. The condition of the brassiere seen in FIG. 2, whereby the loop is adjusted to a maximum depth of neckline and minimum cup size, may be obtained by sliding the strap 20 through the buckle 22 downwardly to minimize the size of the loop and then securing the buckle in its fixed position. After the upper portions of the cups are urged downwardly and gathered to the extent desired, and after the buckle is pivoted downwardly to its locked position, the molding characteristics of the cup portions operate upon the wearer to provide desired support and shaping, and are not hampered by the gathered material within the loop.

It must be appreciated that as the fabric comprising the upper panels is gathered by action of the loop 20, the direction of maximum distensibility of the fabric of the upper panels may be altered slightly, but there is compensation and interplay due to the distensibility features of the panels adjoining the upper panels, such as the lower panels and body encircling panels, and the support feature of the cup portions is not lost or substantially altered. The decorative panels 36 and 37 which are preferably of a non-distensible material would be gathered by the strap 20, but not affect the supporting or molding feature of the brassiere to any noticeable extent as the uppermost edge of the brassiere 10 provides the least amount of support and shaping.

The direction of maximum distensibility, and specific orientation of the fabrics comprising the panels of the cup portions play a particularly important role in providing the advantages of the present invention, and interrelate with one another as well as interrelate and react with the distensibility of the base panels and body encircling panels in achieving such advantages. The brassiere 10 may be manufactured in conventional ways, as would be obvious to those skilled in the art, and except as specifically described herein to the contrary, the brassiere could include conventional features and structure which would not interfere with the action of the cups.

A latitude of modification, substitution, and change is intended in the foregoing disclosure, and in some instances, some features of the present invention may be employed without a corresponding use of other features. Only a preferred embodiment of the present invention has been described herein, and it must be appreciated that it is within the scope of the present invention that the degree and amount of distensibility of the fabrics be altered and varied to accommodate and produce different desired results.

I claim:

1. In a brassiere having bust covering and supporting sections and body encircling sections extending from each side of the bust covering section, and means for adjusting the cup size of the bust covering sections, the improvement comprising:

the cup portions each including a lower panel of a material that is distensible substantially in one direction only, the cup portions each including an upper panel of a material that is distensible substantially in one direction only;

the said upper and lower panels being in engagement with one another along an arcurate line of engagement therebetween, and the alignment of the direction of distensibility of each of said upper and lower panels changing with respect to one another along the said line of engagement;

a body panel of material that is distensible at least around the body of the user;

a means for adjustably gathering and urging downwardly the inner edges of the upper portion of said cup portions; and wherein the alignment of the directions of distensibility of each of said respective upper and lower panels is 180 degrees at one point along the line of engagement therebetween.

2. A brassiere as in claim 1, wherein the alignment of the directions of distensibility of each of said respective upper and lower panels varies to an acute angle at a point spaced from said point of 180 degree alignment.

3. A brassiere as in claim 1, wherein said upper panels of said breast cups includes a decorative edging along the upper edges thereof.

4. A brassiere as in claim 3, wherein said decorative edging is of a material which is not substantially distensible in any direction.

5. A brassiere as in claim 1, wherein said means for adjustably gathering comprises a strap and complementary buckle.

6. A brassiere as in claim 1, wherein said body panel is of a material which is distensible in all directions.

7. A brassiere as in claim 1, wherein there is provided a non-distensible tape disposed in a smooth curve along the bottom edge of the same lower panels.

* * * * *